US006020860A

United States Patent [19]

Miers

[11] Patent Number: 6,020,860

[45] Date of Patent: Feb. 1, 2000

[54] ANTENNA INNER CONDUCTOR AND SHORTS SYSTEM

[75] Inventor: Gary L. Miers, Raymond, Me.

[73] Assignee: Howell Laboratories, Inc., Bridgton, Me.

[21] Appl. No.: 08/840,387

[22] Filed: Apr. 29, 1997

[51] Int. Cl.[7] ..... H01Q 9/04

[52] U.S. Cl. ..... 343/790; 343/791; 343/900

[58] Field of Search ..... 343/790, 791, 343/792, 722, 749, 752, 825, 828–830, 846, 900; H01Q 9/04, 9/16, 5/00, 5/01, 9/40, 9/00, 1/24

[56] References Cited

U.S. PATENT DOCUMENTS 3,733,611 5/1973 Becavin ..... 343/792

3,871,000 3/1975 Tymann ..... 343/771

4,008,479 2/1977 Smith ..... 343/895

4,939,525 7/1990 Brunner ..... 343/745

*Primary Examiner*—Frank G. Font

*Assistant Examiner*—Layla G. Lauchman

*Attorney, Agent, or Firm*—Samuels, Gauthier & Stevens

[57] ABSTRACT

An UHF antenna system having inner antenna conductor and an outer antenna conductor having end caps. The inner conductor is supported by one of the end caps. This provides an electrical short to the outer antenna conductor and a thermal short to ambient.

4 Claims, 2 Drawing Sheets

ANTENNA INNER CONDUCTOR AND SHORTS SYSTEM

BACKGROUND AND BRIEF SUMMARY OF THE INVENTION

In UHF TV broadcast antenna systems, there are inner and outer feed conductors which are joined to inner and outer antenna conductors. The inner feed conductor is received within and concentrically aligned with the outer feed conductor. The inner feed conductor is joined to an inner antenna conductor by a T connector. The inner antenna conductor is 'shorted' to the outer antenna conductor by the "shorts" which are typically comprised of a collar with electrical contacts (generally watchband springs) through which the inner antenna conductor rides. The collars are shorted to the outer antenna conductor usually by means of spokes. The location of the center line of these collars is nominally one wavelength away from the center line of the last radiating slot of each half of the antenna.

Referring to FIG. 1 a prior art antenna system is shown generally at 10 and comprises a lateral outer feed conductor 12 and an inner feed conductor 14. The entire weight of the inner conductor 14 is carried by centering pins 16 with bushings 18 received within the inner conductor 14 and in registration with the centering pins 16 to prevent crushing. An antenna 20 has inner and outer antenna conductors 22 and 24. The inner conductors 14 and 22 are joined by a T connector 26.

The differential expansion of the inner and outer antenna conductors 22 and 24 is accommodated by the inner conductor 22 being allowed to ride through the "short" 28. The "short" 28 allows for an electrical short. However, this design does not provide an efficient thermal short to ambient for the heat energy that is generated in the inner conductor 22. Also, the prior art design loads substantially the entire weight of the inner conductor 14 onto the T conductor 26. This results in the centering pins and bushings being required as just described.

The present invention embodies an antenna design that provides for an electrical short, a thermal short and mechanical support for the inner antenna conductor which design eliminates the need for bushings or the like to prevent crushing of the lateral inner feed conductor.

The inner antenna conductor is mechanically fastened to the antenna top. This provides an electrical short to the outer conductor and a thermal short to ambient. The weight of the inner feed conductor and inner feed antenna conductor is carried by a fastener which is easily sized to carry the load.

DESCRIPTION OF THE PREFERRED EMBODIMENT(S)

Figure 2:
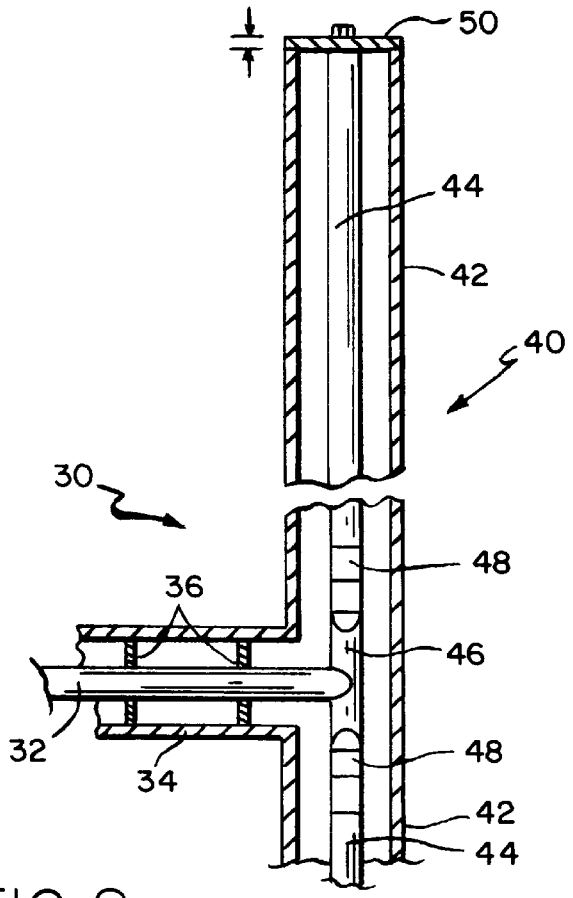
FIG. 2 is a sectional view of an antenna system embodying the invention.

Referring to FIG. 2, an antenna system embodying the invention is shown generally at 30 and comprises inner and outer feed conductors 32 and 34 respectively. Support rods 36 maintain the inner conductor 32 concentrically aligned within the outer conductor 34. An antenna is shown generally at 40 and is coupled to the feed conductors 23 and 34 in a T configuration. The antenna 40 comprises thermally conductive end caps 50 (only one shown), outer conductors 42, inner conductors 44, a T connector 46, and inner conductor expansion connectors 48.

The outer conductors 34 and 42 are rigidly joined one to the other. The inner conductor 44 is joined to the T connector 46 by means of the inner conductor expansion connectors 48. The inner feed conductor 32 is rigidly joined to the T connector 46.

Figure 3:
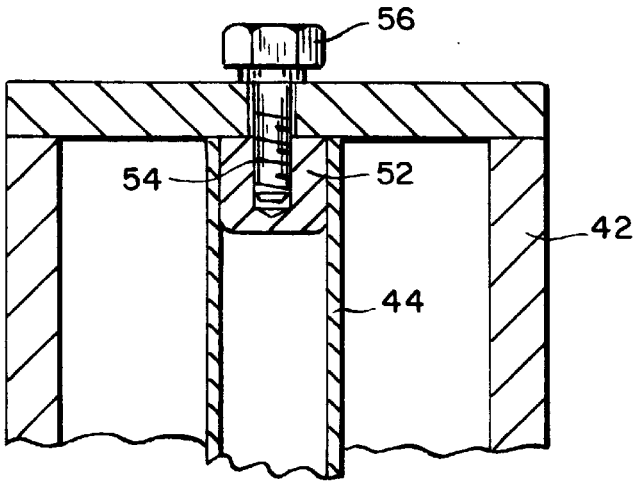
FIG. 3 is an enlarged sectional view of one end of the antenna.

Referring to FIG. 3, the upper end of the conductor 42 has secured thereto the end cap 50. The upper end of the inner conductor 44 has a block 52 fixedly secured therein, which block is characterized by a tapped hole 54. A bolt 56 secures the inner conductor 44 to the end plate 50 and supports the inner feed conductor 32.

EXAMPLE

Figure 1:
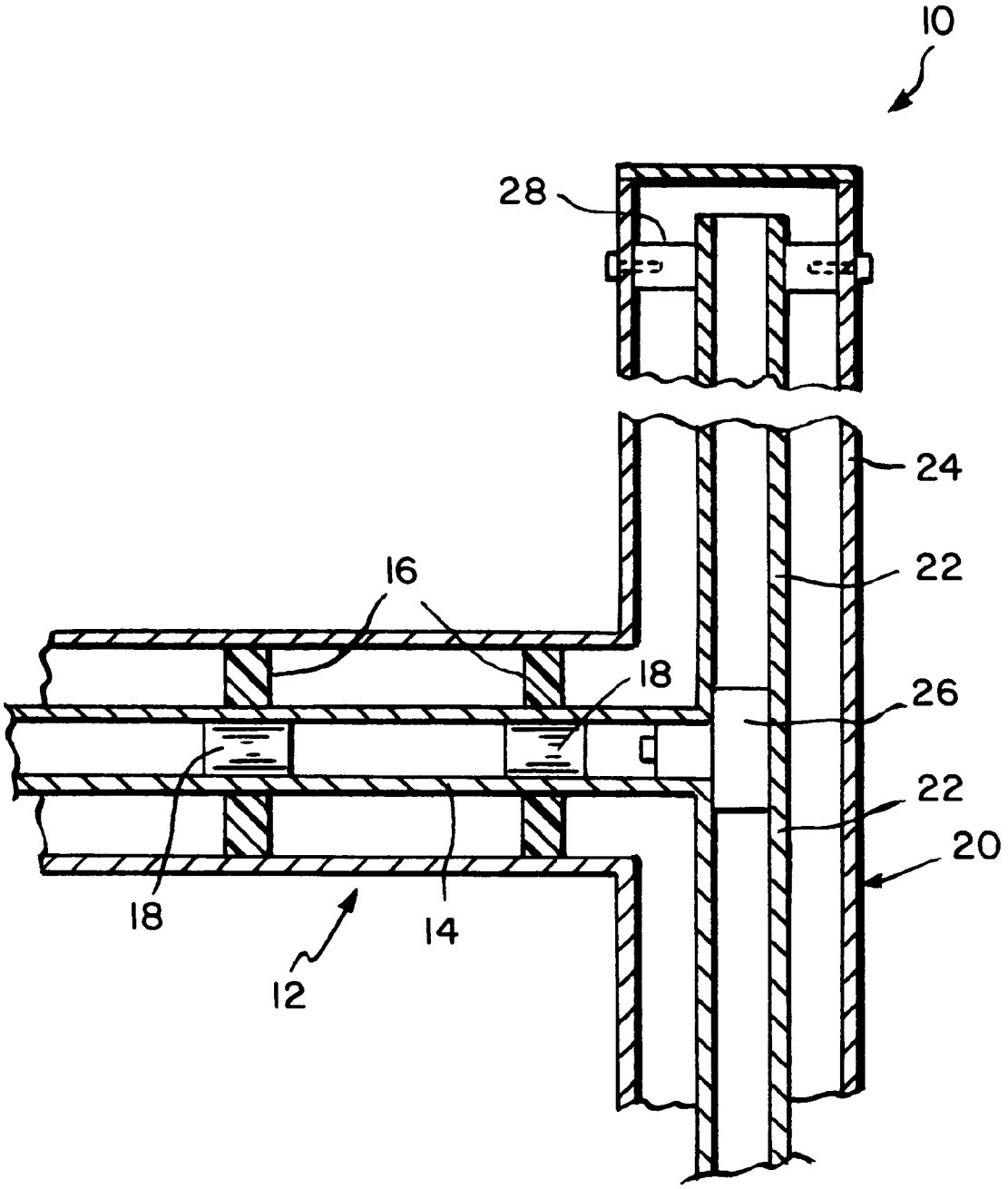
FIG. 1 is an illustration of a prior art UHF broadcast antenna system.

With a prior art 30 foot UHF antenna, referring to FIG. 1, generally the spacing rods and bushings will carry approximately 80 pounds. With a system of the invention, the spokes 36 need only support a total load of approximately four pounds of inner conductor 32 weight. Further, by securing the inner conductor 44 to the thermally conductive end cap 50, e.g. a quarter inch aluminum end cap, with an ambient temperature of 70° F. and a temperature of about 180° F. for the inner conductor, the rate of heat transfer from the antenna of the invention to ambient is increased at least a few hundred percent versus a comparable prior art antenna.

The preferred embodiment has been described with reference to the inner antenna conductor supported by an end cap at the upper end of the antenna. The inner antenna conductor could be supported at the lower end of the antenna or supported by both the upper and lower ends.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. An antenna system comprising:

inner and outer feed conductors;

inner and outer antenna conductors joined transversely to the inner and outer feed conductors respectively, the inner and outer antenna conductors each having upper and lower ends; and means for fixedly securing at least one of the inner antenna ends to one of the outer antenna ends to support the inner feed conductor and to provide electrical shorts to the outer conductor and thermal shorts to ambient.

2. The system of claim 1 comprising:

means for securing the upper ends of the antenna conductors.

3. The system of claim 2 comprising:

an end cap secured to the upper end of the outer antenna conductor and wherein the upper end of the inner antenna conductor is secured to said end cap.

4. The system of claim 3 comprising:

a block staked in the upper end of the inner antenna conductor; and means for threadily engaging the block to the end cap.

* * * * *